US007185981B2

(12) United States Patent
Tham et al.

(10) Patent No.: US 7,185,981 B2
(45) Date of Patent: Mar. 6, 2007

(54) DUPLEX PRINTING

(75) Inventors: Ching Keong Tham, Singapore (SG); Xiaoxi Huang, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 4 days.

(21) Appl. No.: 11/115,667

(22) Filed: Apr. 26, 2005

(65) Prior Publication Data

US 2006/0238594 A1 Oct. 26, 2006

(51) Int. Cl.
*B41L 39/00* (2006.01)

(52) U.S. Cl. ..... 347/104; 347/102; 399/401; 400/582; 100/424.1; 100/484

(58) Field of Classification Search ..... None
See application file for complete search history.

(56) References Cited

U.S. PATENT DOCUMENTS 4,469,026 A * 9/1984 Irwin ..... 101/484
4,566,014 A * 1/1986 Paranjpe et al. ..... 346/25
5,714,990 A * 2/1998 Courtney ..... 347/14
5,784,090 A * 7/1998 Selensky et al. ..... 347/102
5,836,706 A 11/1998 Ruhe
6,149,327 A 11/2000 Ward et al.
6,290,410 B1 9/2001 Sunada et al.
6,293,716 B1 9/2001 Driggers et al.
6,463,256 B2 10/2002 Blackman
6,705,786 B2 3/2004 Trovinger

* cited by examiner

*Primary Examiner*—Judy Nguyen
*Assistant Examiner*—Jill E. Culler

(57) ABSTRACT

An apparatus and a method for duplex printing are disclosed. The apparatus includes a print zone where printing is performed and a duplex module configured to change the orientation of the media sheet. The duplex module is positioned so as to receive the media sheet from the print zone, trailing edge first. The method includes feeding a media sheet to the print zone and printing swaths of ink dots on a first side of the media sheet. Black ink density is calculated for each swath containing black ink dots. The highest black ink density is then determined. The media sheet is stopped from advancing after the last swath has been printed on the first side. The first side is allowed to dry for a drying period, which is based on the highest black ink density. After the drying period has elapsed, the media sheet is moved in the reverse direction from the print zone to the duplex module to change the orientation of the media sheet to an orientation suitable for printing on a second side. If the trailing edge of the media sheet is at a position that cannot enter the duplex module after the last swath has been printed on the first side, the media sheet is moved in the forward direction for a minimum distance to enable the trailing edge to enter the duplex module. The media sheet is then re-introduced into the print zone for printing on the second side.

6 Claims, 4 Drawing Sheets

DUPLEX PRINTING

FIELD OF THE INVENTION

The present invention relates generally to methods and systems for printing on both sides of a media sheet.

BACKGROUND

Printing on both sides of a media sheet, also referred to as duplex printing, is a desirable feature in printing systems. The advantages of duplex printing include reducing the amount of paper required compared to one-sided printing, and generating layouts resembling that of professionally printed books. In conventional duplex printing systems, a media sheet is fed along a media path that includes a print zone and first-side printing is performed in the print zone. After a programmed pause to allow for the first-side to dry, the media sheet is then fed into a duplex handling system which flips the media sheet and returns the sheet to the print zone for second-side printing. The entire media sheet is advanced through the print zone before the programmed pause is activated. The programmed pause is based on the drying time required for the worst-case scenario in which the entire first side is printed with data. Thus, even if only a top portion of the media sheet is printed on the first side, the entire sheet still has to be fed through the print zone and second-side printing is delayed for longer than the required drying time.

There remains a need for a duplex printing method that can improve the throughput for printing on both sides of a media sheet.

SUMMARY

The present invention provides an apparatus and a method for duplex printing. The apparatus includes a print zone where printing is performed and a duplex module configured to change the orientation of the media sheet. The duplex module is positioned so as to receive the media sheet from the print zone, trailing edge first. The method includes feeding a media sheet to the print zone and printing swaths of ink dots on a first side of the media sheet. Black ink density is calculated for each swath containing black ink dots. The highest black ink density is then determined. The media sheet is stopped from advancing after the last swath has been printed on the first side. The first side is allowed to dry for a drying period, which is based on the highest black ink density. After the drying period has elapsed, the media sheet is moved in the reverse direction from the print zone to the duplex module to change the orientation of the media sheet to an orientation suitable for printing on a second side. If the trailing edge of the media sheet is at a position that cannot enter the duplex module after the last swath has been printed on the first side, the media sheet is moved in the forward direction for a minimum distance to enable the trailing edge to enter the duplex module. The media sheet is then re-introduced into the print zone for printing on the second side.

The objects, aspects and advantages of the present invention will become apparent from the following detailed description, taken in conjunction with accompanying drawings.

DETAILED DESCRIPTION

Figure 1:
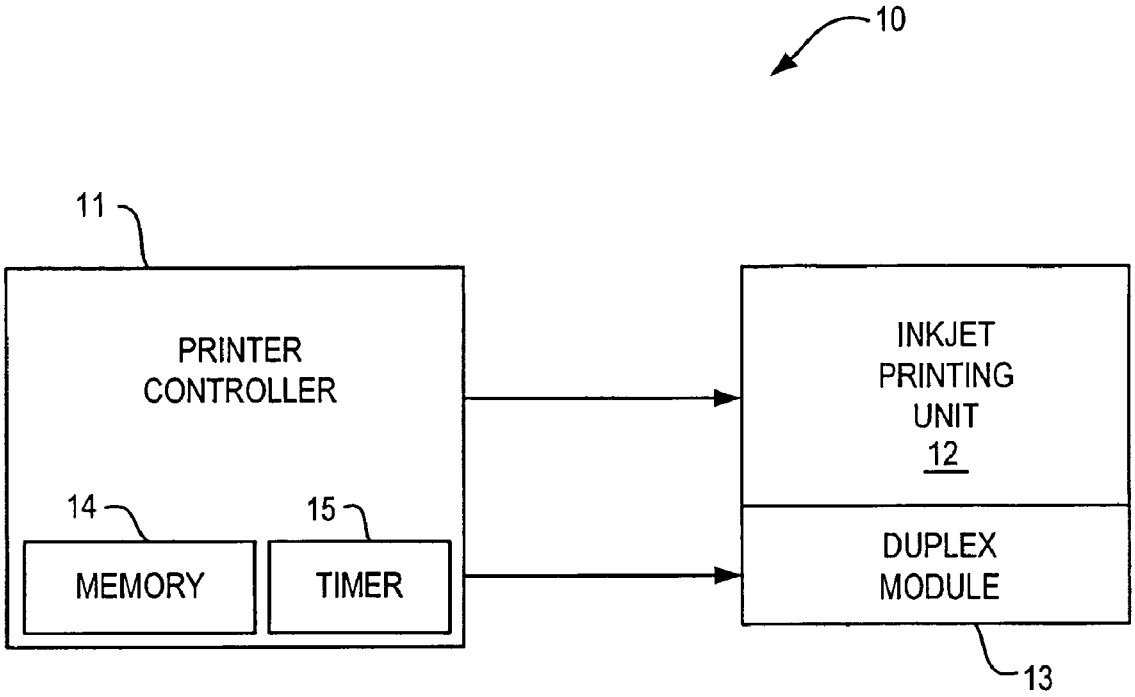
FIG. 1 is a block diagram showing an overview of a duplex printing system according to one embodiment of the present invention.

An overview of a duplex printing system 10 according to one embodiment is shown in FIG. 1. The duplex printing system 10 includes a printer controller 11, an inkjet printing unit 12, and a duplex module 13. The printer controller 11 controls all of the operations of the printing system and includes a memory 14 for storing various information and programs relating to the operations of the printing system. A timer 15 is also available to the printer controller 11.

Figure 2:
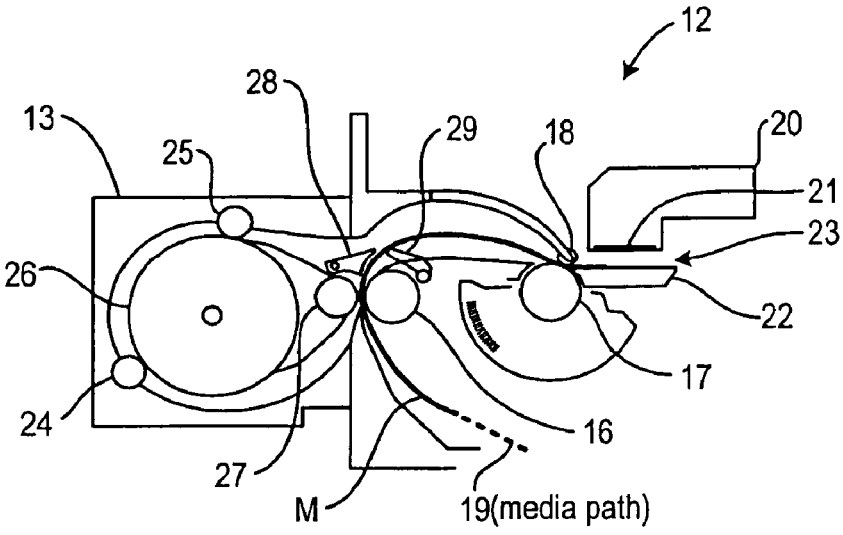
FIG. 2 is a cross-sectional view showing a printing unit coupled to a duplex module according to one embodiment of the present invention.

FIG. 2 shows the components for the inkjet printing unit 12 and the duplex module 13 according to one embodiment. The inkjet printing unit 12 includes turn roller 16, feed roller 17 and pinch roller 18 for moving a media sheet M along a main media path 19. The feed roller 17 and pinch roller 18 cooperate to advance the media sheet to the print zone 21 and to pull the media sheet from the print zone toward the duplex module 13. A plurality of inkjet cartridges 20, often called "pens" by those in the art, are arranged in the printing unit 12 to eject droplets of ink onto the media sheet. Pens of various colors including, cyan (C), magenta (M), yellow (Y), and black (K), are provided so that different color tones may be produced. Each pen has a print head 21 formed with a plurality of small nozzles (not shown) through which the ink droplets are ejected. The pens 20 are mounted on a movable carriage (not shown). A platen 22 is positioned below the pens 20 to support the media sheet during printing. The space between pens 20 and the platen 22 defines a print zone 23.

The duplex module 13 is coupled to the printing unit 12 and includes a pair of pinch rollers 25, 26 in cooperating relationship with a duplex roller 26, a third pinch roller 27 in cooperating relationship with the turn roller 16, and a flip bar 28. A media sensor 29 is positioned along the main paper path 19 but near to the flip bar 28 to detect whether the media sheet has passed beyond the flip bar 28 after first-side printing is completed. The media sensor 29 may be any conventional sensor capable of detecting the presence of the media sheet.

During a printing operation, the media sheet M is fed along the main media path 19 and around turn roller 16. The flip bar 28 is pushed out of the main media path when the media sheet moves around turn roller 16. Beyond the flip bar 35, feed roller 17 and pinch roller 18 cooperate to advance the media sheet in a forward direction toward the print zone 23 for first-side printing. To print an image, the carriage that supports the ink pens 20 traverses back and forth across the media sheet in a direction traverse to the moving direction of the media sheet and the nozzles are activated to eject ink droplets onto the media sheet. Each passage or sweep of the carriage across the media sheet prints a "swath." Each swath is composed of several groups of ink dots printed by the nozzles.

Figure 3:
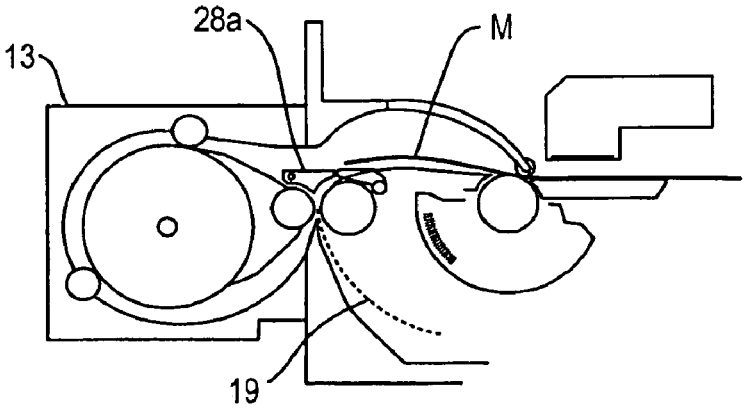
FIG. 3 is a cross-sectional view showing the trailing edge of the print medium just beyond a flip bar located at the entrance of the duplex module in accordance with an embodiment of the present invention.

After first-side printing is completed and the trailing edge (or bottom edge) of the media sheet is detected by the media sensor 29 as having moved beyond the flip bar 28, the first side is allowed to dry for a sufficient drying period. If the trailing edge has not passed beyond the flip bar 28 because only a top portion of the first side is printed, then the media sheet is advanced forward for a minimum distance so that the trailing edge is just beyond the flip bar as shown in FIG. 3. After the drying period has elapsed, the rotational directions of the feed roller 17 and pinch roller 18 are reversed to move the printed media sheet in the reverse direction. At this time, the flip bar 28 is moved to an unbiased position that blocks the path around turn roller 16 toward the input region of the main paper path 19. This unbiased position is shown in FIG. 3. The unbiased position enables the media sheet to move over a supporting surface 28*a* of the flip bar and enter the duplex module 13.

Figure 4:
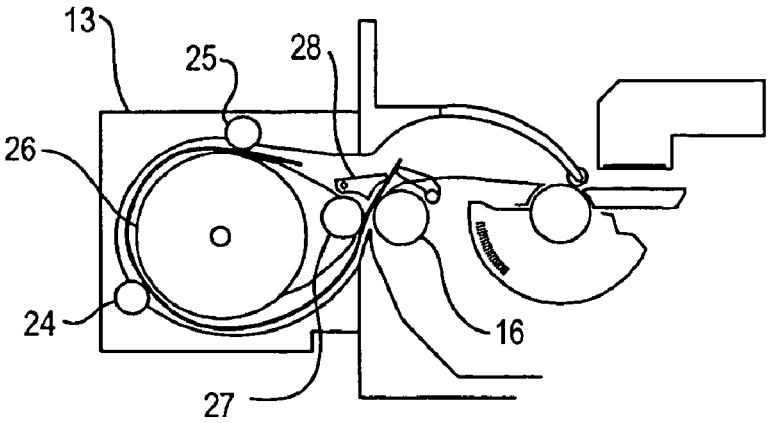
FIG. 4 shows a cross-sectional view showing the print medium moving through the duplex module in accordance with an embodiment of the present invention.

Referring to FIG. 4, the pinch rollers 24, 25 and the duplex roller 26 cooperate to move the media sheet along a loop path in the duplex module 13, thereby changing the orientation of the media sheet for second-side printing. At the end of the loop path 30, the trailing edge of the media sheet reaches pinch roller 27. At this time, the pinch roller 27 cooperates with turn roller 16 to return the media sheet back onto the main media path toward the print zone 23. The trailing edge becomes the leading edge as the media sheet moves toward the print zone. To move effectively along the duplex paper path, the media sheet should be limited to a length such that the leading edge and the trailing edge can not be overlapped near the flip bar. The media sheet is then fed to print zone 23 for second side printing. After second-printing is finished, the media sheet is transferred to an output region, e.g. an output tray.

Figure 5:
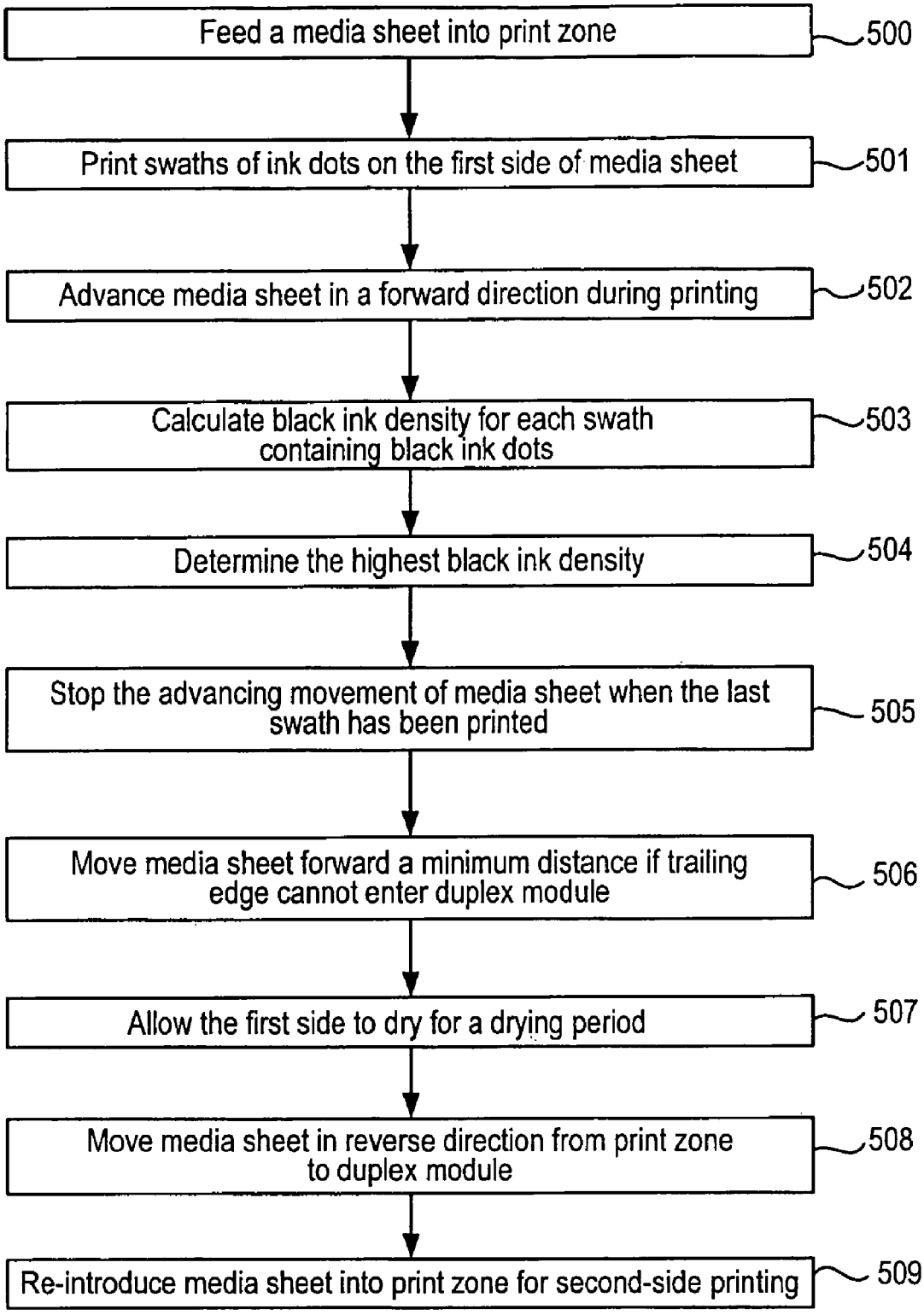
FIG. 5 is a flow chart showing a method for duplex printing in accordance with one embodiment of the present invention.

FIG. 5 is a flow chart showing a method for duplex printing in accordance with one embodiment of the present invention. This method is carried out in the duplex printing system described above. At step 500, a media sheet is fed into the print zone in a first orientation suitable for printing on a first side. Next, at step 501, swaths of ink dots are printed on the first side of the media sheet, wherein at least one swath contains black ink dots. At step 502, the media sheet is advanced in a forward direction during printing. At step 503, the black ink density for each swath containing black ink dots is calculated. The highest black ink density is then determined at step 504. At step 505, the media sheet is stopped from advancing forward after the last swath has been printed on the first side. If the trailing edge of the media sheet is at a position that cannot enter the duplex module, the media sheet is moved forward a minimum distance to enable the trailing edge to enter the duplex module at step 506. At step 507, the first side is allowed to dry for a drying period based on the highest black ink density. At step 508, the media sheet is moved in the reverse direction from the print zone into the duplex module. The media sheet is then re-introduced back into the print zone for second-side printing at step 509.

Figure 6:
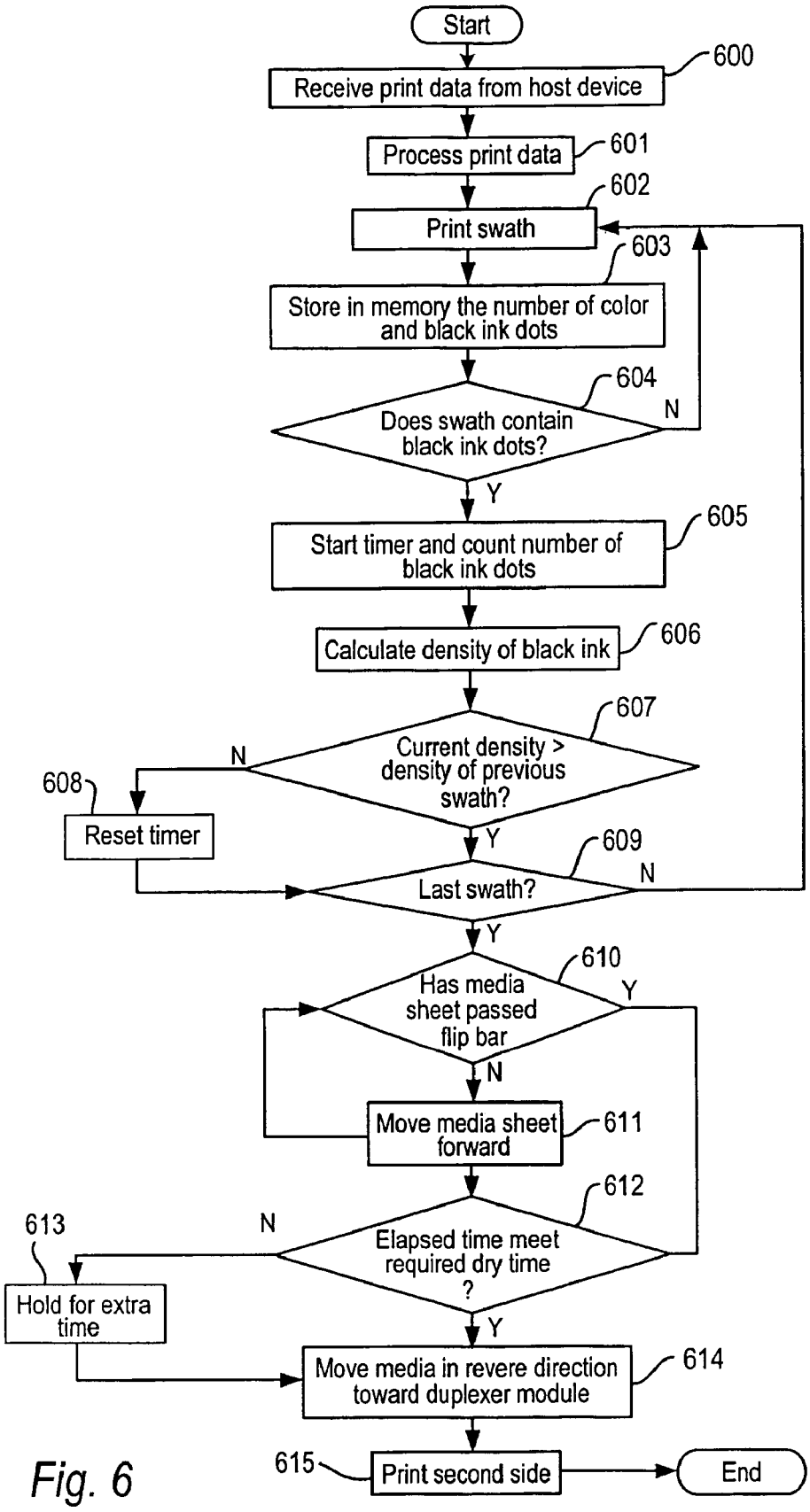
FIG. 6 is a flow chart showing a more detailed embodiment of the method shown in FIG. 5 in accordance with an embodiment of the present invention.

FIG. 6 shows a more detailed embodiment of the flow chart shown in FIG. 5. The printer receives print data from a host device such as a personal computer, a scanner, or a workstation, at step 600. The print data is an electronic representation of a document or image to be printed. This print data may be in the form of a raster scan image such as a full page bitmap or in the form of an image written in a page description language (PDL) or a combination thereof. At step 601, the printer controller processes the print data. This data processing includes color mapping and halftoning. Color mapping involves converting the RGB color pixel data from the original print data to CMYK data that is specific to the printer. Under this process, the printer controller will try to map the gamut of the colors as close as possible to the RGB space. The printer controller will also attempt to linearize by mapping input primary tones to a linear, nominal output response (KCMY space). Haftoning is a process that allows a continuous tone image to be modified in order that it may be represented by a printer that can only represent a finite number of tone levels. A hafttone image includes a selectively positioned arrangement of dots of fixed tone levels, thereby creating the illusion of a continuous tone image. After color mapping and halftoning, the printer controller performs "swath processing," which includes dividing the transformed print data into swaths and determining which part of the print data is to be printed.

At step 602, the printer controller sends instructions to various printing mechanisms to cause a swath to be printed on a first side of a media sheet. At step 603, the printer controller stores in its memory the number of the color and black ink dots from that particular swath. Next, at step 604, the first swath is examined to check whether the first swath contains black ink dots. If the answer is no, the printer controller returns to step 602 to perform the printing of the next swath. If the answer is yes, the printer controller starts the timer and counts the number of black ink dots in step 605. At step 606, the printer controller converts the number of black ink dots in the printed swath to volume of black ink, then calculates the density (D) of black ink using the following formula:

$$D = \frac{V}{L \times H}$$

where V is the volume of black ink, L and H are the length and height of the swath, respectively. At step 607, the printer controller determines whether the density calculated for the current swath is greater than the density of a previous swath. In other words, step 607 records the highest density of black ink in a swath. If the answer in step 607 is no, then the timer is reset and re-started at step 608 prior to proceeding to step 609. If the answer in step 607 is yes (or the current swath is the first swath), then the controller checks whether the current swath is the last swath to be printed on the first side in step 609. If the current swath is not the last, then steps 602–607 are repeated.

If the last swath has been detected, the controller checks whether the trailing edge of the media sheet has passed beyond the flip bar of the duplex module in step 610. If no, then the media sheet is advanced forward a minimum distance to a waiting position just beyond the flip bar in step 611. In step 612, the controller determines whether the elapsed time recorded by the timer has met the drying time. The drying time is determined by looking-up the recorded highest black ink density in a Drying Time Table previously stored in the memory of the printer controller. If the answer in step 612 is no, then the printed media sheet is maintained in the same position at step 613 until the drying time has elapsed. If the answer in step 612 is yes (i.e., the drying time has elapsed), then the media sheet is moved in the reverse direction toward the duplex module, where the media sheet is flipped (step 614). In step 615, second-side printing is performed in the print zone.

One major advantage of the above-disclosed embodiments is that second-side printing is activated based on the amount of data printed on the first-side. Accordingly, these embodiments allow the first side of the media sheet to stop at variable positions based on the length of the printed image.

It is intended that the embodiments contained in the above description and shown in the accompanying drawings are illustrative and not limiting. It will be clear to those skilled in the art that modifications may be made to these embodiments without departing from the scope of the invention as defined by the appended claims.

What is claimed is:

1. A duplex printing method comprising:

providing a printing apparatus that comprises: means for transporting a media sheet along a first media path for printing on a first side of the media sheet; a print zone along said first media path: and a duplex module configured to change the orientation of the media sheet from a first orientation to a second orientation suitable for printing on a second side of the media sheet, the entrance to the duplex module being located along said first media path and upstream of the print zone;

printing swaths of ink dots on a top portion of the first side of the media sheet in the print zone, at least one swath containing black ink dots;

advancing the media sheet in a forward direction during printing;

calculating black ink density for each swath containing black ink dots;

determining the highest black ink density;

stopping the advancing movement of the media sheet after the last swath has been printed on the first side, whereby the trailing edge of the stopped media sheet has not bypassed the entrance to the duplex module;

detecting that the trailing edge of the stopped media sheet has not bypassed the entrance to the duplex module;

moving the media sheet in the forward direction for a minimum distance to enable the trailing edge to enter the duplex module;

allowing the first side to dry for a drying period, the drying period being based on the highest black ink density;

moving the dried media sheet in a reverse direction from the print zone to the duplex module to change the orientation of the media sheet from the first orientation to a second orientation suitable for printing on a second side of the media sheet; and re-introducing the media sheet into the print zone for printing on the second side.

2. The method of claim 1, further comprising:

providing a flip bar adjacent to the entrance to the duplex module so as to guide the reversing media sheet into the duplex module, wherein the flip bar is positioned such that, when the media sheet is moving along the first path, the leading edge of the media sheet must bypass the flip bar before entering the print zone.

3. The method of claim 2, wherein detecting that the trailing edge of the stopped media sheet has not bypassed the entrance to the duplex module comprises using a media sensor positioned adjacent to the flip bar to detect that the trailing edge has not bypassed the flip bar.

4. A printer comprising:

means for transporting a media sheet along a first media path for printing on a first side of the media sheet;

a print zone along said first media path;

inkjet printing mechanism arranged in said print zone for forming swaths of ink dots on the media sheet;

a duplex module configured to change the orientation of the media sheet from a first orientation to a second orientation suitable for printing on a second side of the media sheet, the entrance to said duplex module being located along said first media path and upstream of the print zone;

means for moving the media sheet in a reverse direction from the print zone to the duplex module;

a media sensor located adjacent to the entrance to the duplex module to detect whether the trailing edge of the media sheet has bypassed said entrance; and a controller configured to:

(a) control the printing operation to enable swaths of ink dots to be printed on a top portion of the first side of the media sheet;

(b) calculate black ink density in each swath containing black ink dots;

(c) determine the highest black ink density;

(d) stop the advancing movement of the media sheet after the last swath has been printed on the first side, whereby the trailing edge of the media sheet has not bypassed the entrance to the duplex module when the last swath has been printed;

(e) receive output from the media sensor indicating that the trailing edge of the stopped media sheet has not bypassed the entrance to the duplex module;

(f) move the media sheet in the forward direction for a minimum distance to enable the trailing edge to enter the duplex module after;

(g) determine a drying time based on the highest black ink density;

(h) allow the first side to dry according to the drying time calculated; and (i) move the dried media sheet in a reverse direction from the print zone to the duplex module.

5. The printer of claim 4 further comprising:

a flip bar adjacent to the entrance to the duplex module so as to guide the reversing media sheet into the duplex module, wherein the flip bar is positioned such that, when the media sheet is moving along the first media path, Othe leading edge of the media sheet must bypass the flip bar before entering the print zone.

6. The printer of claim 5 wherein said media sensor is positioned adjacent to the flip bar.

* * * * *

UNITED STATES PATENT AND TRADEMARK OFFICE

CERTIFICATE OF CORRECTION

PATENT NO. : 7,185,981 B2
APPLICATION NO. : 11/115667
DATED : March 6, 2007
INVENTOR(S) : Ching Keong Tham It is certified that error appears in the above-identified patent and that said Letters Patent is hereby corrected as shown below:

Column 6, line 45, “the duplex module after” should read -- the duplex module --.

Column 6, line 58, “Othe leading edge” should read -- the leading edge --.

Signed and Sealed this

Twelfth Day of June, 2007

JON W. DUDAS
*Director of the United States Patent and Trademark Office*